US005788582A

United States Patent [19]

Shapiro

[11] Patent Number: 5,788,582

[45] Date of Patent: Aug. 4, 1998

[54] GOLF TRAINING DEVICE AND METHOD

[76] Inventor: Gerald M. Shapiro, 2012 Subida Ter., Carlsbad, Calif. 92009

[21] Appl. No.: 946,110

[22] Filed: Oct. 2, 1997

[51] Int. Cl.[6] ..... A63B 69/36

[52] U.S. Cl. ..... 473/220; 473/409

[58] Field of Search ..... 473/220, 409, 473/282

[56] References Cited

U.S. PATENT DOCUMENTS

| | | | |
|---|---|---|---|
| 3,953,034 | 4/1976 | Nelson | 273/186 C |
| 3,954,271 | 5/1976 | Tredway | 473/220 X |
| 5,161,802 | 11/1992 | Daechsel | 273/186.3 |
| 5,288,080 | 2/1994 | Tice | 273/186.3 |
| 5,401,030 | 3/1995 | Halliburton | 273/186.3 |
| 5,467,991 | 11/1995 | White, IV et al. | 273/186.3 |
| 5,544,888 | 8/1996 | Pellegrini | 473/220 |

*Primary Examiner*—George J. Marlo
*Attorney, Agent, or Firm*—Baker & Maxham

[57] ABSTRACT

A golf swing training device configured to be coupled to the grip of a golf club by the fingers of the golfer and to project beams of light parallel to the axis of the club shaft. The training device is so configured that it can accommodate substantially any golf club grip and can be moved from club to club at will. It selectively projects a light on the ground to provide real time feedback to the golfer as to the correct position of the club during both the backswing and the downswing.

15 Claims, 5 Drawing Sheets

GOLF TRAINING DEVICE AND METHOD

BACKGROUND OF THE INVENTION

1. Field of the Invention

This invention relates generally to golf training devices and more particularly to a golf swing training device employing a light to provide immediate visual feedback when the golfer swings a club.

2. Description of the Related Art

The number and types of golf swing training devices are boundless. Efforts have been made for decades to perfect the golf swing for the non-perfect golfer. The use of lights or light beams in such training devices is relatively recent. Such devices employing lights in some manner are evidenced by several issued U.S. patents. Examples include Daechsel U.S. Pat. No. 5,161,802 employing a relatively complex swing practice device designed to have a "feel" (swing weight) similar to a normal golf club, but it is not an actual club. U.S. Pat. No. 5,288,080, issued to Tice, employs a modified golf club head with several lights mounting in its upper surface so that, in a stroboscopic manner, the user, that is, the person who swings the golf club, can see by the location and manner in which the lights are lit, how close to ideal the swing is. Halliburton U.S. Pat. No. 5,401,030 employs at attachment to a golf club which includes a centrifugal sensor to determine the swing speed of the club, and a light which is directed toward the user's eyes. U.S. Pat. No. 5,544,888, issued to Pellegrini, adds a light to the butt end of the club shaft which points to the ground at certain times during the swing, enabling the user to visibly determine whether the club is being swung through the proper path or on the proper swing plane during that portion of the swing. Nelson U.S. Pat. No. 3,953,034 employs a laser device mounted on the shaft of a normal golf club which projects a beam of light toward the club head on which is mounted a mirror to project a fan-shaped beam along the ground ahead of the club face. This is intended to enable the user to see the line of light on the ground as the ball is hit so that the golfer can immediately determine whether the ball is being hit straight, with a hook, or with a slice.

A particularly relevant device is shown in White, IV, et al. U.S. Pat. No. 5,467,991. This patent discloses a light device for connection to an actual golf club by the user and discusses the concept of the ideal swing plane where the downwardly projecting light beam traces a straight line behind the ball during the backswing and the oppositely directed light beam picks up that same line when the golf club is properly swung as the club approaches the top of the backswing. The reverse is true on the downswing and the golfer knows that the swing has been properly made when both lights, sequentially, project a beam which extends along the same line behind, through, and in front of the ball as the swing is made.

SUMMARY OF THE INVENTION

Broadly speaking, this invention provides a practical device adapted to be coupled to a golf club by the normal grip of the golfer and projects a beam of light in both directions parallel to the club shaft.

A major feature of this invention is that the light device is coupled to the club shaft by the golfer's fingers in the normal grip position engaging the grip of the club. For this reason, there is no problem of centrifugal force, which can be a very large force as the device is positioned between the golfer's hands and the club head. Centrifugal force is not relevant to the training device of this invention. Another feature of the device is that if the golfer should, for some reason, let go of the club, the training device will remain in the golfer's hands. In other words, the device cannot go flying off in a dangerous manner, no matter what the golfer does with respect to the swing or the grip.

It is a principle that when the golf swing is made in the proper manner, the shaft will remain generally on a plane through the ball throughout the backswing and the downswing. This is graphically illustrated on pages 47, 114 and 115 of the July 1997 issue of Golf Magazine. It is also a basis for the training device of U.S. Pat. No. 5,467,991.

The lights in the device of this invention preferably project a generally collimated beam in both directions parallel to the axis of the golf club shaft. This beam is easily seen by the golfer and is bright enough to trace on the ground a beam intense enough to be visible during the golf swing. The light device of this invention readily shows the golfer if the club is in proper position at the beginning of the backswing and at a position approaching the top of the backswing. The same is also true of the downswing where the golfer can easily visibly determine that the beam of light projects on or close to the desired line when the swing is properly made.

An important part of this training device is that the golfer can readily determine, from the position of the light beam during the backswing and the downswing, if the swing is off the desired plane and what must be done to correct the incorrect aspects of the swing. Simply swinging the club with perceived corrections is immediately rewarded with feedback as the golfer visually determines whether the swing is getting closer to the desired ideal and if the club is being maintained on the proper swing plane. A side benefit is that use of the device of this invention trains the golfer to keep the head down, that is, to focus on the ball, as the club head passes through the hitting area.

BRIEF DESCRIPTION OF THE DRAWING

The objects, advantages and features of this invention will be more readily perceived from the following detailed description, when read in conjunction with the accompanying drawing, in which.

DETAILED DESCRIPTION OF THE PREFERRED EMBODIMENTS

Figure 1:
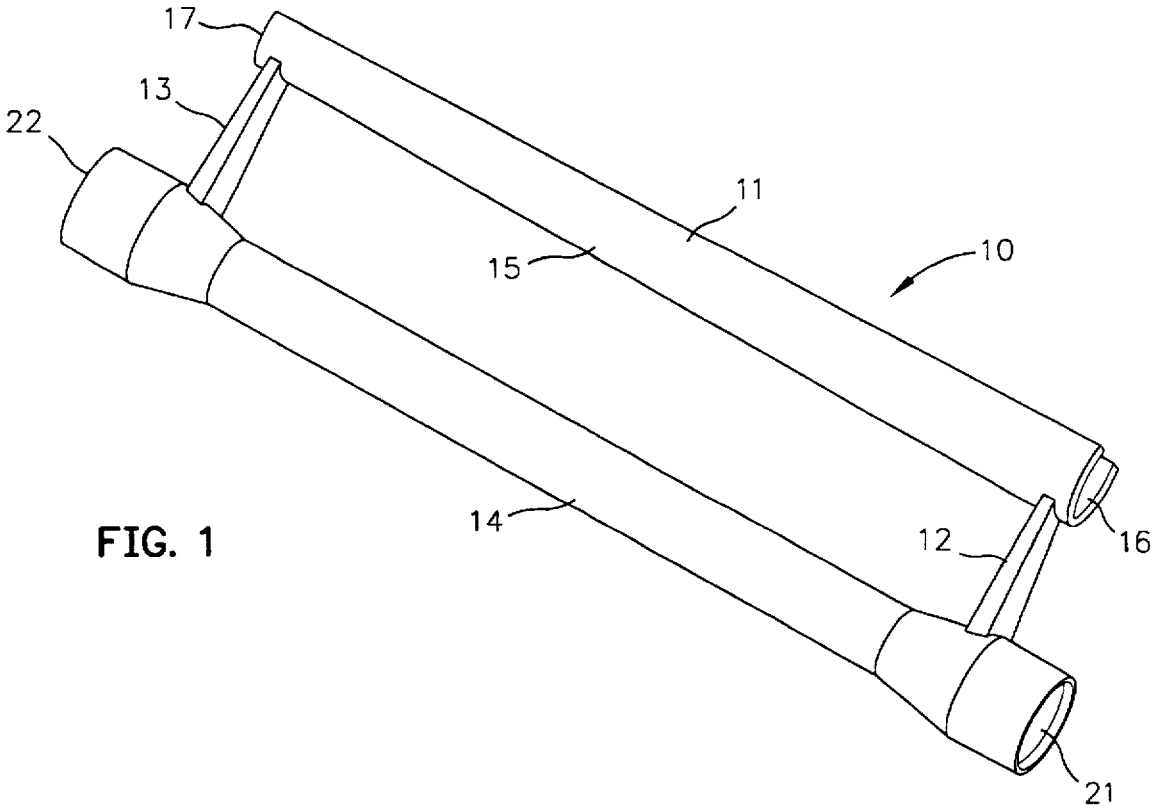
FIG. 1 is a perspective view of the training device of the invention.

With reference now to the drawing and more particularly to FIG. 1, there is shown elongated handle member 11 having standoff members 12 and 13 projecting outwardly therefrom. Elongated body member 14 is mounted to the outer ends of standoff members 12 and 13 so that the body member is fixed to handle member 11 at a distance greater than the thickness of the golfer's fingers as they wrap around the grip of the club and around convex surface 15 of the handle member. The opposite surface of handle member 11 is concave and tapers somewhat from end 16 to end 17 to thereby accommodate the normally tapered grip of the club. The elongated concave side of handle member 11 is configured to receive and engage a portion of the grip of the club.

Figure 2:
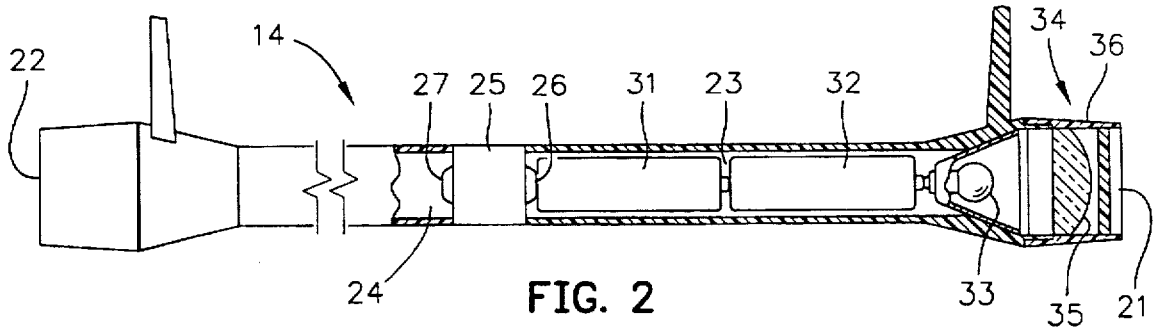
FIG. 2 is a partial cross-sectional view of the light generating device of the invention.

Body member 14 has dual cavities 23, 24, as shown FIG. 2, to retain batteries 31, 32 therein, for example. At each end 21 and 22 there are typical assemblies 34, including bulb 33, the normal apparatus to retain the bulb in contact with the batteries in the body and to make the necessary electrical contact when the bulb is to be lit, means to focus the light emitted by the bulb, and a typical switching mechanism. Often the switching mechanism is actuated by rotating assembly head 36 with respect to the body, but any effecting switching means may be used to turn the light on and off. Many appropriate lighting devices may be used, the only requirement being that the bulb produces a relatively powerful light beam that is made to be as close to being collimated as possible to thereby provide a small spot to be readily visible as it moves along the ground. A suitable example for the light is a xenon beam bulb with appropriate batteries to power it. As shown in FIG. 2, the light produced by the bulb is focused by lens 35. Alternatively, the conical reflector surrounding the bulb may focus the beam with or without the use of a lens.

Body member 14 is preferably made as small as possible while maintaining sufficient battery power to result in the desired light beam. Appropriate lenses are available and need not be specifically identified here. The basic requirement is that the batteries, light bulb and lens combination produce a small spot at a distance of about three to six feet. While it is anticipated that the light assemblies at ends 21 and 22 of body 14 will be identical, it is possible that the lens assembly at end 22 will be structured to provide a small beam of light at a range of approximately three to six feet and the lighting assembly at end 21 will be fine tuned to provide a small spot of light at a distance of about four to seven feet. This allows for the fact that end 22 is closer to the ground in its functionally observable positions while end 21, being effective higher in the backswing, will be further from the ground when its light beam is functionally effective.

In body member 14, compartments 23 and 24 may be separated by central spacer 25 on either side of which are spring contact members 26 and 27. While two batteries are shown, different numbers of batteries may be used and any one of several different battery sizes may be appropriate. The lighting structure is shown somewhat schematically and the purpose is only to generally depict how it might be configured. Its construction and means for turning the light on or off are not directly pertinent to the present invention. Commercially available products can satisfy the light beam requirements of this invention. They may be a type of flashlight or they may be laser lighting devices.

Figure 3:
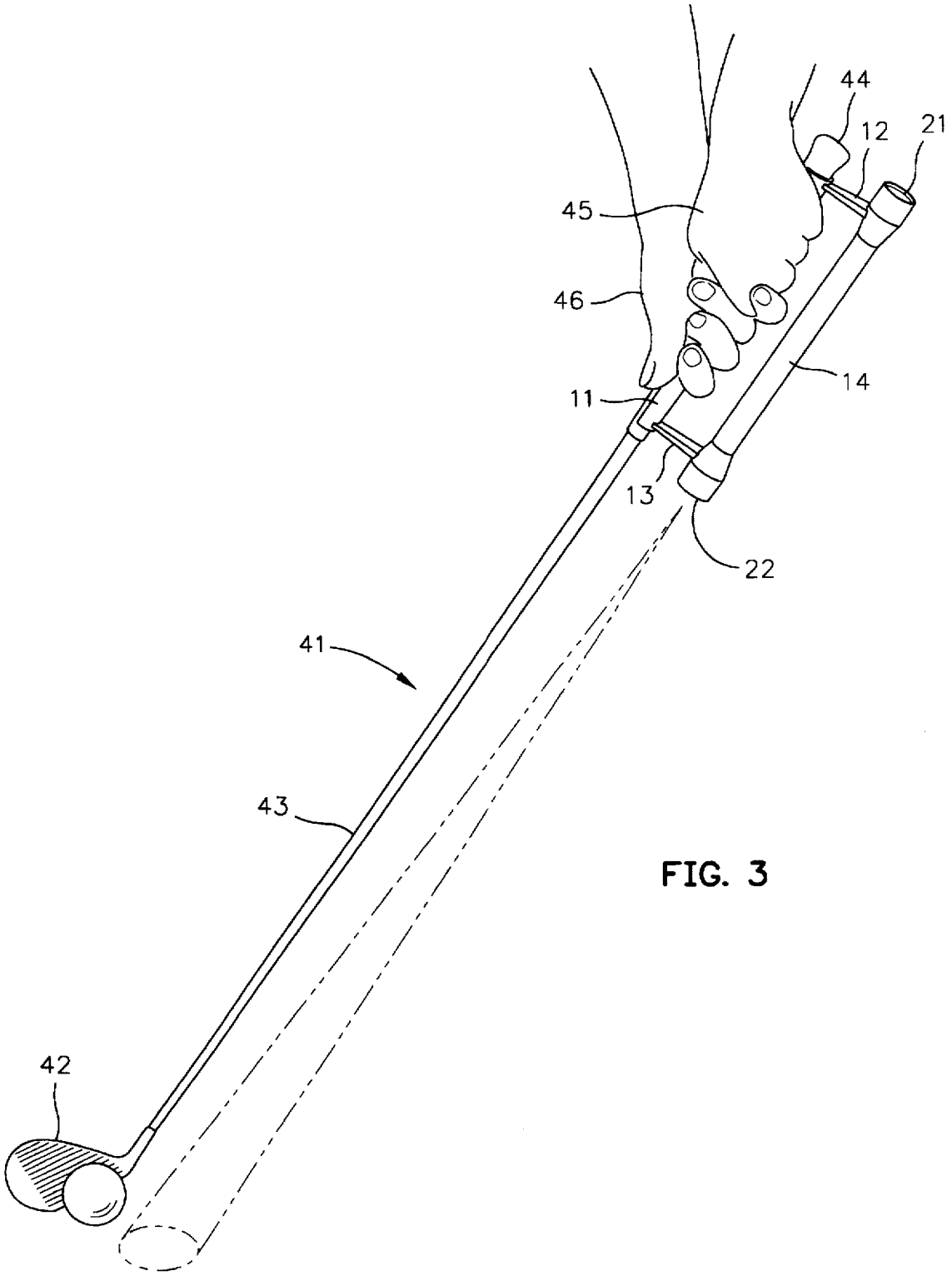
FIG. 3 shows the invention as it would be gripped by a golfer in actual use in conjunction with a normal golf club.

In FIG. 3 the training device of the invention is shown in conjunction with golf club 41 having head 42, shaft 43 and grip 44. As shown, the fingers of left hand 45 and right hand 46 are in the standard overlapping golf grip. Note that the fingers of both hands securely hold handle member 11 in a position to particularly encircle and engage grip 44. The fingers of the golfer are clear of body member 14 which is held in a position substantially parallel with shaft 43. Thus it can be seen that in order to use the training device of the invention with any golf club, it is merely necessary to release the grip on the combination of the club and the training device and apply the device in the same way to the grip of a different club. By taking a normal position and grip, the golfer securely engages the training device with the club, the alignment with the shaft of the club being ensured by the fact that handle member 11 is longitudinally concave and generally matches the convex shaped of the golf club grip. Note that if, for some reason, the golf club should become disengaged from the grip of the golfer, the training device cannot become a projectile. The fingers of the golfer, are positioned between handle 11 and body 14, between standoff members 12 and 13, so that the training device cannot fly off in any direction, even if the golf club slips out of the hands of the golfer.

If standoff members 12 and 13 are the same length, the light beam from head 22 will tend to generally converge toward the head of the club at the end of shaft 43. If it is desired to maintain the light beam from end 22 as close to parallel as possible with the shaft axis, standoff 13 will be slightly longer than standoff 12 to account for the taper of the shaft and grip.

Figure 4:
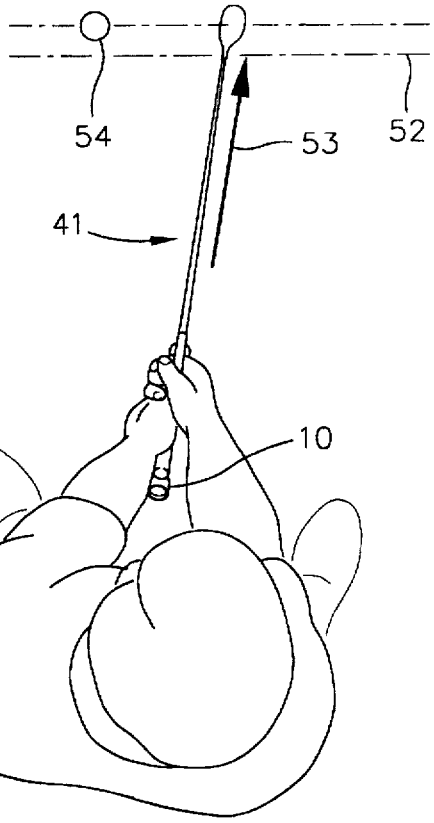
FIG. 4 shows the light path traced by the device of the invention at the beginning of the backswing when the device is coupled to a golf club.
Figure 5:
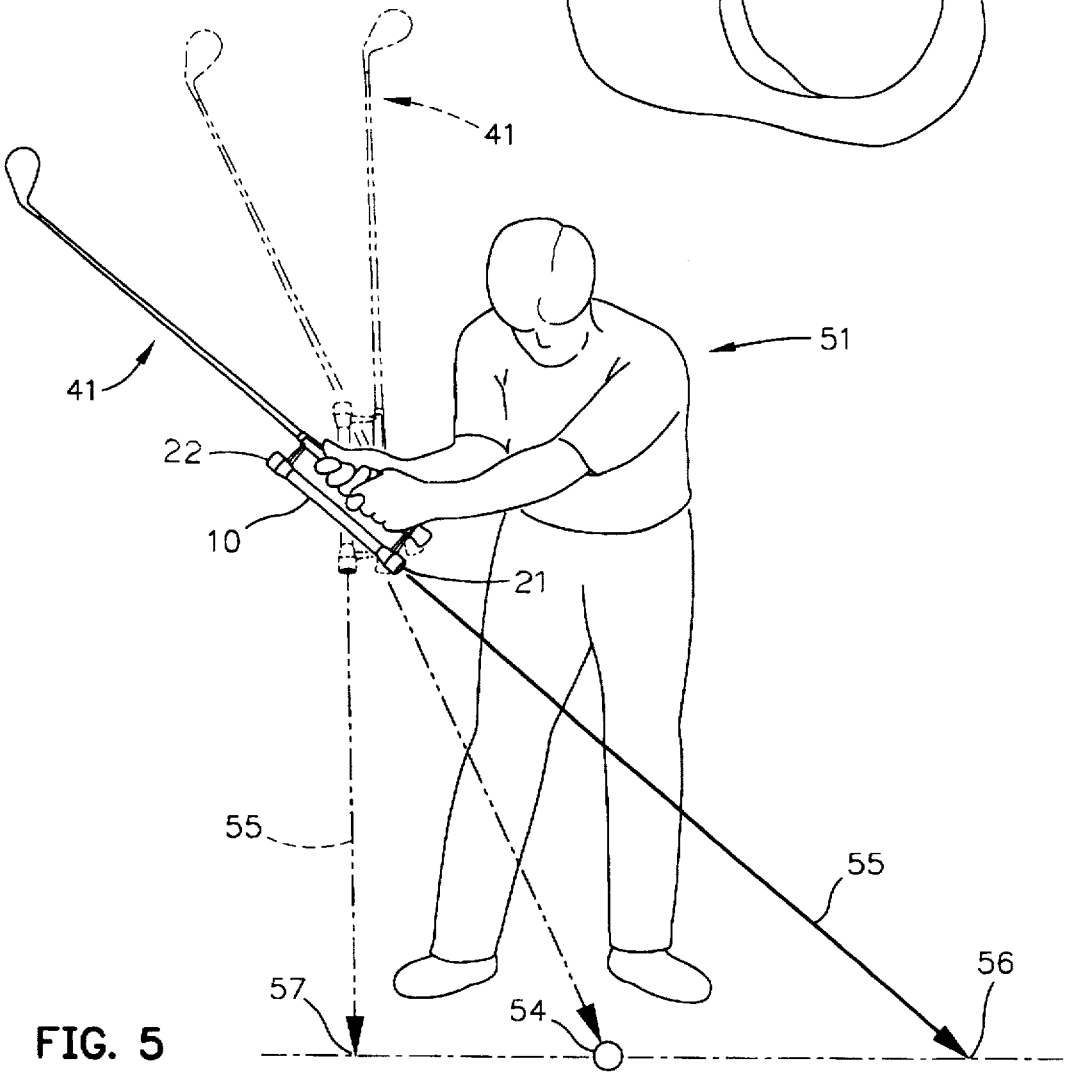
FIG. 5 shows how the light beam projecting from the butt end of the club shaft intersects the ground as the backswing progresses toward the top.

The proper backswing is shown in FIGS. 4 and 5. In FIG. 4, golfer 51 commences the backswing of club 41 and training device 10 provides beam of light 53 focused on line 52 which is located just inside, or toward the golfer from, ball 54. This positioning of beam 53 on line 52 continues until the golf club rises in the course of the backswing and no longer points downwardly. Continuation of the backswing results in light beam 55 from end 21 of the light device (at the butt end of the club) intersecting the ground in front of ball 54 at position 56 and moving rearwardly to and beyond position 57 behind the ball. All of these positions, as shown in FIG. 5, should be on a line parallel to the desired line of flight of the ball—line 52 in FIG. 4.

After the downswing commences, light beam 55 from end 21 of training device 10 intersects line 52 behind position 57 and moves along that line toward and beyond the ball, out to position 56 as the downswing continues. As the club head approaches the hitting area, the light beam from end 22 once again travels along path 52 and that continues on out as the club head strikes the ball.

Figure 6:
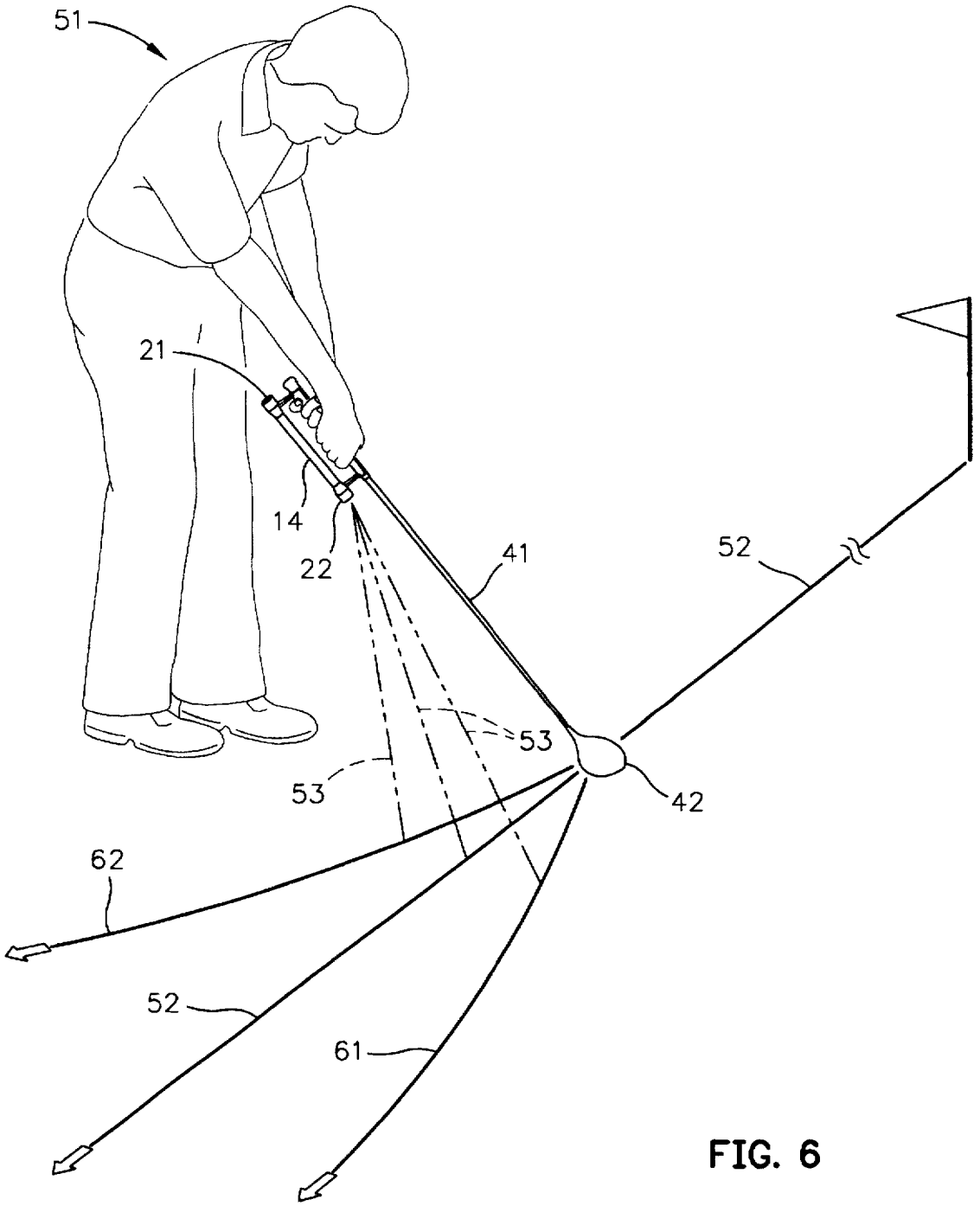
FIG. 6 shows light paths for backswings on, inside and outside of the desired line.
Figure 7:
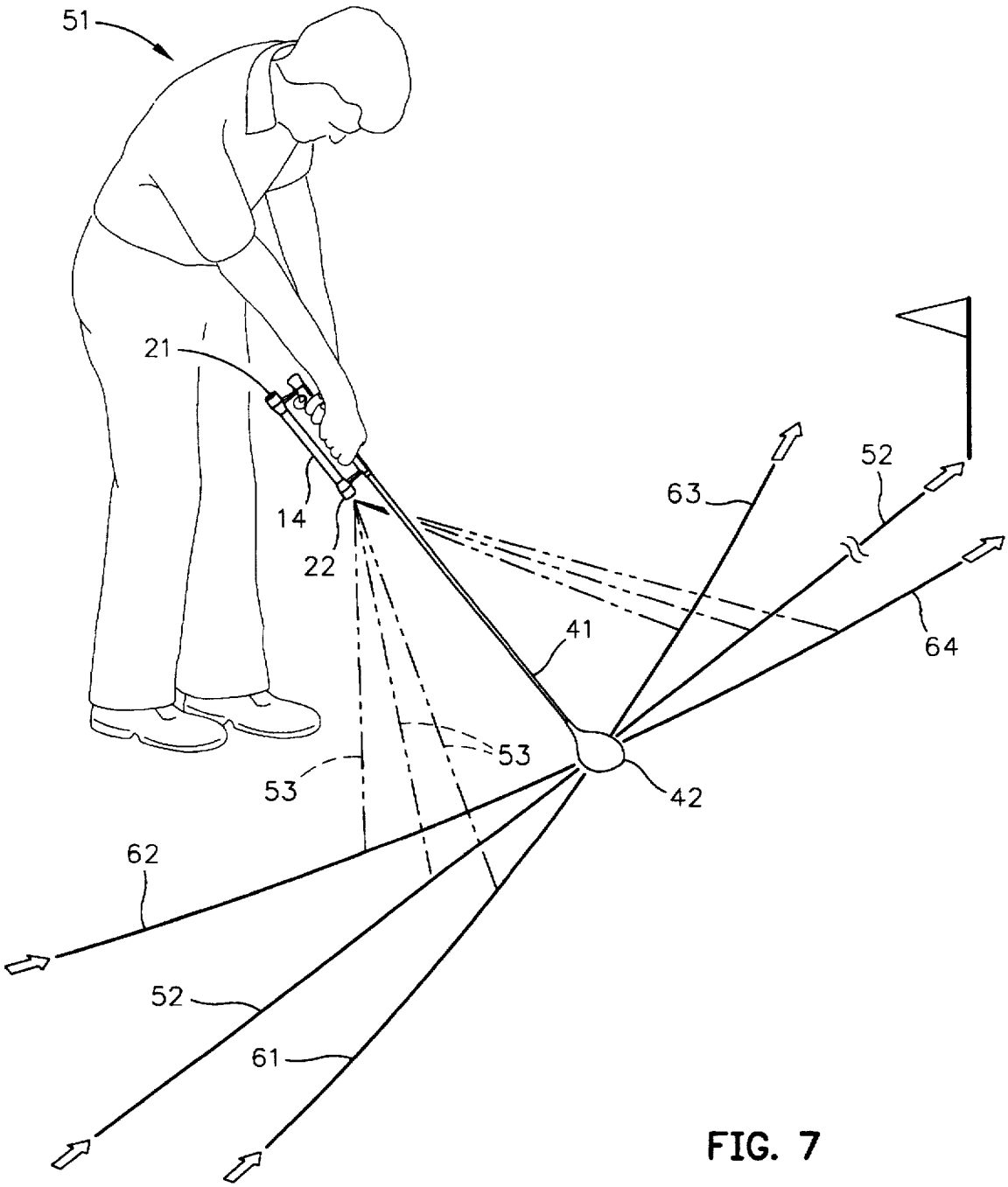
FIG. 7 shows various combinations of inside and outside downswings with respect to the desired centered downswing.

Less than desirable swings are represented in FIGS. 6 and 7. With reference to FIG. 6, during the takeaway at the commencement of the backswing, beam 53 traces path 61 outside line 52, indicating improper commencement of the golf swing. However, a correction can be made by the golfer to position the downswing on the desired line. This will normally require an undesirable and swing-inefficient loop at the top of the backswing which may take years to duplicate on a regular basis. Alternatively, beam 53 may trace path 62 inside the ideal path, leading to different but related swing problems.

FIG. 7 shows how the normal takeaway along line 52 leads to a continuation through the hitting area along the same line toward the target. However, when the takeaway is along outside path 61, the completion of the stroke could be along path 63, cutting across the ball and resulting in a slicing, left to right, trajectory, or a shot pulled to the left. Similarly, a takeaway along path 62 could naturally lead to path 64 through the hitting area. This would normally result in a draw or hook flight path, moving the ball from right to left, or a shot pushed to the right.

Other combinations of takeaway and downswing paths could be manufactured by the golfer. However, the purpose of the device of the invention is to function as a training aid, to help the golfer develop a repeatable swing along path 52. This is readily visually revealed throughout the swing by the device of this invention.

The on-line takeaway and on-line downswing, indicated by light beams 53, 55 moving along path 52, are considered to be the most desired to produce the most successful golf shot and that which the golfer would most want to replicate. If the path of light deviates from positions along path 52 it means that there are incorrect aspects to the swing and corrections should be made to produce the proper club head path and effective, repeatable golf shots. Another training advantage of the device of the invention is that while the golfer is learning the swing based upon the positions of the respective light beams of the training device, the golfer is, with conscious intention, keeping the head down and thereby seeing the ball and the path of the club as it strikes the ball. This is generally considered to be a desirable characteristic of a golf swing.

Another advantage of the device of the invention is that by positioning it as close as possible to the butt end of the club, the device has the least effect on the feel and swing weight of the club. Note that in all of the identified prior art devices, except U.S. Pat. No. 5,544,888, the golf swing training device is located at some position either on the shaft below the hands or at or in the vicinity of the club head. These all must either be taken into account or they simply greatly affect the feel and swing weight of the club. The Pelligrini device only has a light at the butt end of the club so it has little or no effect on the swing weight. However, it also does not function in the same way as the device of the present invention.

The light beam training device of the invention can be employed with a ribbon, string or a rope of appropriate contrasting color laid along the ground, or it could be used with a line on, or the edge of, a carpet or with any other means for identifying a straight line. In the preferred embodiment, handle 11, standoffs 12 and 13 and body 14 would be molded in one piece, preferably from a highly durable, substantially rigid, lightweight polymer. However, several elements may be used which are secured together by appropriate means. The materials used could be anything that is functionally appropriate, the main requirements being durability, relative rigidity, and light weight. Handle member 11, coupled with the standoffs and light body, is ergonomically designed to be captured in the golfers hands as the club is properly gripped. The light body can be attached to and spaced from the handle member by any effective means, so the particular shape and configuration of standoffs 12 and 13 could vary. With appropriate rigidity, only one standoff at one end of the training device could be adequate, so that body 14 would be cantilevered from one end.

The training device of the present invention has been described in conjunction with an actual golf club and that is its preferred use. However, a simulated golf club could also be used with the invention and the term "golf club" is intended to mean any such instrument with which the invention is used.

In view of the above description it is likely that modifications and improvements to the invention will occur to those skilled in the art. It is intended that the invention be limited only by the spirit and scope of the following claims.

What is claimed is:

1. A golf swing training device configured to function cooperatively with a golf club having a shaft with a longitudinal axis and a longitudinally convex grip on its proximal end, said device comprising:

an elongated handle member shaped and configured to accommodate the grip of the golf club;

an elongated body member mounted to said handle member and spaced therefrom;

said body member having means for projecting a beam of light from at least one end of said body member generally parallel to the shaft axis;

said device being configured to be coupled to said golf club grip by the user's fingers as they are positioned around said golf club grip and said handle member of said device in a normal grip position, the user's fingers passing between said handle member and said body member of said golf swing training device.

2. The device recited in claim 1, and further comprising standoff members securing said body member to said handle member.

3. The device recited in claim 2, wherein said standoff members are of equal length.

4. The device recited in claim 2, wherein said standoff members have respective lengths configured to cause the light beam to project in a direction parallel to the shaft axis.

5. The device recited in claim 1, wherein said light projecting means comprises lighting devices for selectively projecting beams of light both toward and away from the distal end of the golf club.

6. A golf swing training device configured to function cooperatively with a golf club having a shaft with a longitudinal axis and a longitudinally convex grip on its proximal end, said device comprising:

an elongated handle member shaped and configured to accommodate the grip of the golf club;

standoff members mounted to said handle member and projecting outwardly therefrom;

an elongated body member mounted to said standoff members and positioned substantially parallel to and spaced from said handle member;

said body member having means for projecting a beam of light from at least one end of said body member generally parallel to the shaft axis;

said device being configured to be coupled to said golf club grip by the user's fingers as they are positioned around said golf club grip and said handle member of said device in a normal grip position, the user's fingers passing between said handle member and said body member of said golf swing training device.

7. The device recited in claim 6, wherein said handle member is arcuate in a direction perpendicular to its length to enable said handle member to partially encircle the grip of the golf club, the length of said handle member being at least sufficient to permit all of the user's fingers to rest therein in a normal grip position.

8. The device recited in claim 7, wherein said standoff members comprise one said standoff member adjacent to each end of said handle member so that all of the user's fingers are positioned between said standoff members.

9. The device recited in claim 6, wherein said standoff members comprise one said standoff member adjacent each end of said handle member.

10. The device recited in claim 6, wherein said beam of light projecting means comprises means for projecting a beam of light from each end of said body member generally parallel to the axis of the shaft.

11. The device recited in claim 10, wherein said body member is formed with two longitudinally spaced cavities wherein said means for projecting a beam of light comprises batteries within said cavities, and appropriate electrical contacts, switches and bulb and lens assemblies at either end of said body member for selectively projecting a substantially collimated beam of light from each end of said body member.

12. A golf swing training device configured to function cooperatively with a golf club having a shaft with a longitudinal axis and a longitudinally convex grip on its proximal end, said device comprising:

an elongated longitudinally concave handle member configured to accommodate the grip of the golf club;

standoff members mounted at each end of said handle member and projecting radially outwardly therefrom;

an elongated body member mounted to said standoff members and positioned substantially parallel to and spaced from said handle member; and means within said body member for projecting a beam of light from each end of said body member generally parallel to the shaft axis;

said device being configured to be coupled to said golf club grip by the user's fingers as they are positioned around said golf club grip and said handle member of said device in a normal grip position, the user's fingers passing between said handle member and said body member of said golf swing training device.

13. A training method for a golf swing of a golf club comprised of a shaft having a longitudinally convex grip on its proximal end, the method comprising the steps of:

providing apparatus having a means to selectively project a light beam in at least one direction;

energizing the light in the apparatus;

engaging the apparatus with the golf club by gripping with the fingers of the golfer encircling the golf club grip and a portion of the apparatus in a normal golf grip manner so as to project a beam of light substantially to the golf club shaft; and swinging the golf club so that the light beam passes along the ground to show the golfer the condition of the swing.

14. The method recited in claim 13, wherein the apparatus has two oppositely directed, selectively energizable light beam projecting means, whereas when both light beam projecting means are energized, the backswing at the beginning and as it approaches the top, and the downswing from near the top and through the ball impact area, are such that both beams of light pass along the ground throughout the swing so as inform the golfer as to the condition of the swing.

15. The method recited in claim 13, and comprising the further steps of releasing the grip, removing the apparatus from one club and reengaging the apparatus with another club for training of the golfer therewith.

* * * * *